US011517501B2

(12) United States Patent
Wersland et al.

(10) Patent No.: US 11,517,501 B2
(45) Date of Patent: Dec. 6, 2022

(54) VIBRATING BALL ASSEMBLY WITH REDUCED VIBRATION SECTION

(71) Applicant: Therabody, Inc., Los Angeles, CA (US)

(72) Inventors: Jason Wersland, Manhattan Beach, CA (US); Benjamin Nazarian, Los Angeles, CA (US); Jaime Sanchez Solana, Los Angeles, CA (US); Eduardo Merino, Los Angeles, CA (US); Richard Tang, Shenzhen (CN)

(73) Assignee: Therabody, Inc., Los Angeles, CA (US)

( * ) Notice: Subject to any disclaimer, the term of this patent is extended or adjusted under 35 U.S.C. 154(b) by 0 days.

(21) Appl. No.: 17/524,964

(22) Filed: Nov. 12, 2021

(65) Prior Publication Data

US 2022/0142857 A1 May 12, 2022

Related U.S. Application Data

(60) Provisional application No. 63/125,223, filed on Dec. 14, 2020, provisional application No. 63/112,858, filed on Nov. 12, 2020.

(51) Int. Cl.

| | |
|---|---|
| ***A61H 23/00*** | (2006.01) |
| ***A61H 23/02*** | (2006.01) |
| ***A61H 15/00*** | (2006.01) |

(52) U.S. Cl.

CPC ..... *A61H 23/0263* (2013.01); *A61H 15/0078* (2013.01); *A61H 2015/0042* (2013.01); *A61H 2015/0071* (2013.01); *A61H 2201/0169* (2013.01); *A61H 2201/1215* (2013.01)

(58) Field of Classification Search

CPC ..... A61H 23/0263; A61H 2015/0071

See application file for complete search history.

(56) References Cited

U.S. PATENT DOCUMENTS

| | | | | |
|---|---|---|---|---|
| 4,116,233 A | | 9/1978 | Scaduto | |
| 5,145,473 A | | 9/1992 | Henry | |
| 5,389,063 A | | 2/1995 | Wu | |
| 5,413,551 A | | 5/1995 | Wu | |
| 5,697,230 A | * | 12/1997 | Ender | B08B 3/12 366/127 |
| 6,203,470 B1 | | 3/2001 | Lundin | |

(Continued)

FOREIGN PATENT DOCUMENTS

EP 3042643 3/2019

OTHER PUBLICATIONS

Hypersphere Mini, Aug. 19, 2020.

(Continued)

*Primary Examiner* — LaToya M Louis

(74) *Attorney, Agent, or Firm* — Sterne, Kessler, Goldstein & Fox P.L.L.C.

(57) ABSTRACT

A vibrating ball assembly that includes an inner shell that defines an inner shell interior and includes an outer surface, a motor positioned in the inner shell interior, an eccentric weight that is configured to be rotated by the motor, and an outer cover at least partially covering the outer surface of the inner shell. The inner shell includes an upper hemisphere and a lower hemisphere. The outer shell includes a reduced vibration section positioned in the lower hemisphere.

17 Claims, 11 Drawing Sheets

(56) References Cited

U.S. PATENT DOCUMENTS

| | | | | |
|---|---|---|---|---|
| 6,432,071 | B1 | 8/2002 | Hsieh | |
| 6,707,177 | B1 * | 3/2004 | Campbell | H02K 5/148 310/239 |
| 7,141,012 | B2 | 11/2006 | Lin | |
| 7,452,307 | B2 | 11/2008 | Chuang | |
| 8,702,568 | B2 | 4/2014 | Klabunde | |
| 8,758,280 | B2 | 6/2014 | Wallace | |
| D738,521 | S | 9/2015 | Matsuura | |
| D738,522 | S | 9/2015 | Matsuura | |
| 9,132,055 | B1 | 9/2015 | Wallace | |
| 9,839,575 | B2 | 12/2017 | Slocum | |
| RE46,790 | E | 4/2018 | Klabunde | |
| D823,951 | S | 7/2018 | Marton | |
| 10,252,116 | B2 | 4/2019 | Marton | |
| 10,413,474 | B2 | 9/2019 | Dills | |
| 10,449,112 | B2 | 10/2019 | Godfrey | |
| 10,548,809 | B2 | 2/2020 | Slocum | |
| 2002/0117931 | A1 * | 8/2002 | Campbell | H02K 5/148 310/233 |
| 2004/0249322 | A1 * | 12/2004 | Cohen | A61H 15/00 601/131 |
| 2011/0071446 | A1 | 3/2011 | Citrin | |
| 2015/0148722 | A1 | 5/2015 | McLean | |
| 2015/0272774 | A1 | 10/2015 | Lee | |
| 2015/0359701 | A1 | 12/2015 | Moyer | |
| 2016/0113841 | A1 | 4/2016 | Godfrey | |
| 2016/0346162 | A1 * | 12/2016 | Powers | A61F 7/007 |
| 2017/0106249 | A1 | 4/2017 | Marton | |
| 2017/0117771 | A1 * | 4/2017 | Orand | H02K 7/06 |
| 2017/0260986 | A1 * | 9/2017 | Zhang | H02K 1/32 |
| 2017/0361697 | A1 * | 12/2017 | Haupt | H02K 5/1732 |
| 2018/0055723 | A1 | 3/2018 | Bick | |
| 2019/0159958 | A1 | 5/2019 | Reycroft | |
| 2019/0314240 | A1 | 10/2019 | Diperi | |
| 2019/0365596 | A1 * | 12/2019 | Conklin | A61H 15/00 |
| 2020/0114220 | A1 | 4/2020 | Huang | |
| 2020/0261307 | A1 | 8/2020 | Wersland | |
| 2021/0128399 | A1 | 5/2021 | Wersland | |

OTHER PUBLICATIONS

Tratac ActiveBall—High Intensity Fitness Vibration Ball/Back Pain & Recovery Massage Ball (9Hx18L, Grey), Aug. 19, 2020.
Sedona, 4 Speed Vibrating Massage Ball, Rechargeable Textured Foam Roller, Muscle Tension Pain and Pressure Relieving Fitness Massaging Balls, Myofascial Release for Feet Arms Back and Neck, Black, Aug. 19, 2020.
Vibrating Back Roller Massage Ball with Double Trigger Point Balls and Powerful Lithium-Ion Batteries for Deep Tissue Release by Miracle Vibration, Aug. 19, 2020.
Cabanana 4-Speed Vibrating Massage Ball—Deep Tissue Washable Electric Training Fitness Physical Therapy Ball for Muscle Myofascial Recovery, Leg Neck Arm Body Back Yoga Ball, Aug. 19, 2020.
Ultimate Massage Ball with Heat and Vibration. Tested and Recommended by Therapists. Get a Warm Massage for Instant Pain Relief, Fast Recovery, Better Performance and Sleep, Aug. 19, 2020.
Vulken Acusphere vibrating massage ball, Aug. 19, 2020.
LifePro Agility 4-Speed Vibrating Massage Ball For Yoga and Deep Tissue Therapy, Aug. 19, 2020.
Myostorm Meteor 2.0, Aug. 19, 2020.
Sharper Image Vibration Massage Ball, Aug. 19, 2020.
Vive Health, Vibrating Massage Ball, Aug. 19, 2020.
Nextrino, InfinityBall Vibrating Massage Ball, Aug. 19, 2020.
Drivelineplus Vibrating Massage Ball—Baseball Warm-Up Tool, Aug. 19, 2020.
LPD Vibrating Massage Ball Electric Massage Roller, Aug. 19, 2020.
Bivi 4-Speed Vibrating Massage Ball—Therapy Ball for Myofascial Release, Trigger Point Massage, Plantar Fasciitis, Foot, Back, Legs, Deep Tissue Massage Therapy, Aug. 19, 2020.
Wolady Vibrating Massage Ball, Wolady 4 Speed High Intensity Rechargeable Vibration Fitness Massaging Balls, Sphere Electric Foam Roller for Massage, Deep Tissue Recovery, Muscle Training, Myofascial Release, Aug. 19, 2020.
Proper Living Co. Proper Sphere, Aug. 19, 2020.
Zen Vibrating Massage Ball, Aug. 19, 2020.
EverTone Vibrating Massage Ball, Aug. 19, 2020.
FeelGoodStore Vibrating Massage Ball, Aug. 19, 2020.
Suvius Vibrating Ball, Aug. 19, 2020.
Vivanstar Vibration Massage Ball Relax Body Model MT8402, Aug. 19, 2020.
FITINDEX Electric Massage Ball, Vibrating Massage Ball 4-Speed Intensity for Deep Tissue Massage Therapy, Fitness Yoga Massage Roller Ball Rechargeable for Pain Relief Muscle Recovery, Aug. 19, 2020.
TriggerPoint MB Vibe Massage Ball Roller, Aug. 19, 2020.
Vibey Ball: Vibrating Massage Ball, Aug. 19, 2020.
AcuFit Vibrating Massage Ball, Aug. 19, 2020.
TimTam Polish Light: The Vibrating Massage Ball that Revolutionizes Recovery.
Ironedge Vibrating Massage Ball, Aug. 19, 2020.
Planet Fitness Vibrating Foam Massage Ball for Deep Tissue Trigger Point Massage, Aug. 19, 2020.
PyroFit Vibrating Massage Ball, Aug. 19, 2020.
Aptonia Electronic Vibrating Massage Ball 900, Aug. 19, 2020.
Summa Vibrating Yoga Ball, Aug. 19, 2020.
International Search Report and Written Opinion issued in PCT/US2021/059198.

* cited by examiner

VIBRATING BALL ASSEMBLY WITH REDUCED VIBRATION SECTION

CROSS-REFERENCE TO RELATED APPLICATIONS

This application claims the benefit of U.S. Provisional Application No. 63/125,223, filed Dec. 14, 2020 and U.S. Provisional Patent Application No. 63/112,858, filed Nov. 12, 2020, the entireties of which are incorporated by reference herein.

FIELD OF THE INVENTION

The present invention relates to a vibrating ball assembly, and more particularly to a vibrating ball assembly with a reduced vibration section.

BACKGROUND OF THE INVENTION

Vibrating massage rollers that are typically made of foam are known. For example, see U.S. Patent Publication No. 2016/0113841, the entirety of which is incorporated by reference herein. U.S. Patent App. No. 2021/0128399, U.S. Pat. Nos. 10,449,112 and 5,413,551 are incorporated herein by reference in their entireties. Furthermore, vibrating massage balls or spheres are known. However, the use of vibrating rollers can be noisy because the part of the roller or ball in contact with the ground causes the ground or floor to vibrate, which produces noise.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention, there is provided a vibrating ball assembly that includes an inner shell that defines an inner shell interior and includes an outer surface, a motor positioned in the inner shell interior, an eccentric weight that is configured to be rotated by the motor, and an outer cover at least partially covering the outer surface of the inner shell. The inner shell includes an upper hemisphere and a lower hemisphere. The outer shell includes a reduced vibration section positioned in the lower hemisphere.

The present invention is a vibrating fitness or massage ball that, in a preferred embodiment, uses a brushless motor that rotates an eccentric or counterweight to provide vibrations to at least a portion of the outer surface. The present invention can incorporate technology from related massage roller assemblies, other vibrating fitness balls or percussive therapy devices. For example, see U.S. Pat. No. 10,252,116, and U.S. Patent Publication No. 2020/0261307, the entireties of which are incorporated by reference herein.

In a preferred embodiment, the vibrating ball assembly includes wireless connectivity and can connect to a digital platform (and one or more associated apps) so that the device can be controlled via a remote electronic device (e.g., a smart phone) and can collect data regarding usage that can be stored in a database and used for providing custom routines and therapy for the user. The app can provide specific protocols and or routines that are designed to provide benefits to the user, such as recovery, warm up, therapy, etc.

Eccentric or counter weights and the shape thereof are known. Preferably, a small percentage of the weight is located on one side of the rotating shaft and a much larger percentage of the weight is located on the opposite side. This weight distribution at least partially contributes to the vibrations being directed principally to the upper hemisphere of the inner shell and lower vibrations directed to the reduced vibration section. In another embodiment, the eccentric weight can include corners and/or right angled surfaces that provides abrupt motion and vibration.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
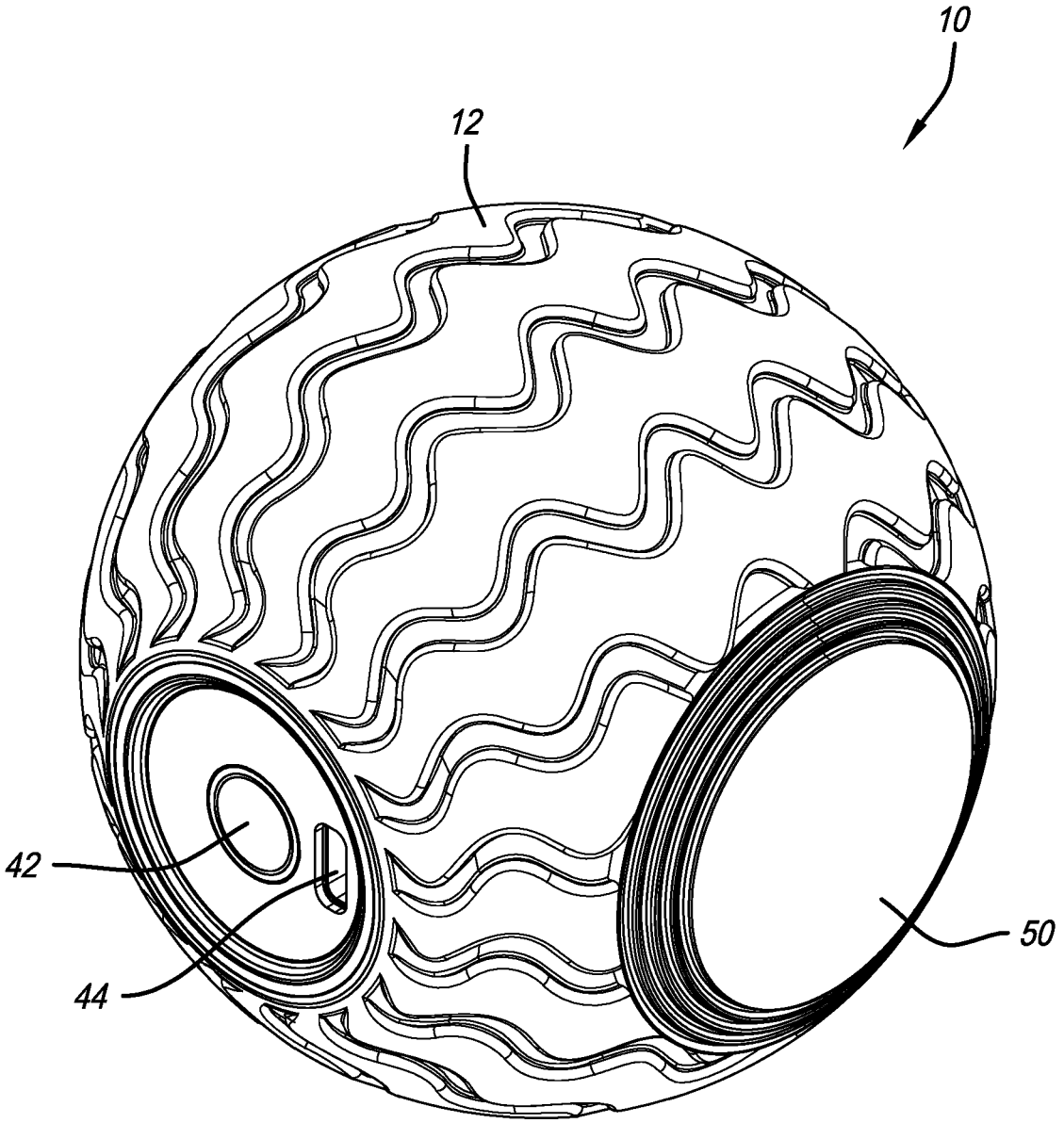
FIG. 1 is a perspective view of a vibrating ball assembly in accordance with a preferred embodiment of the present invention attached thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 2:
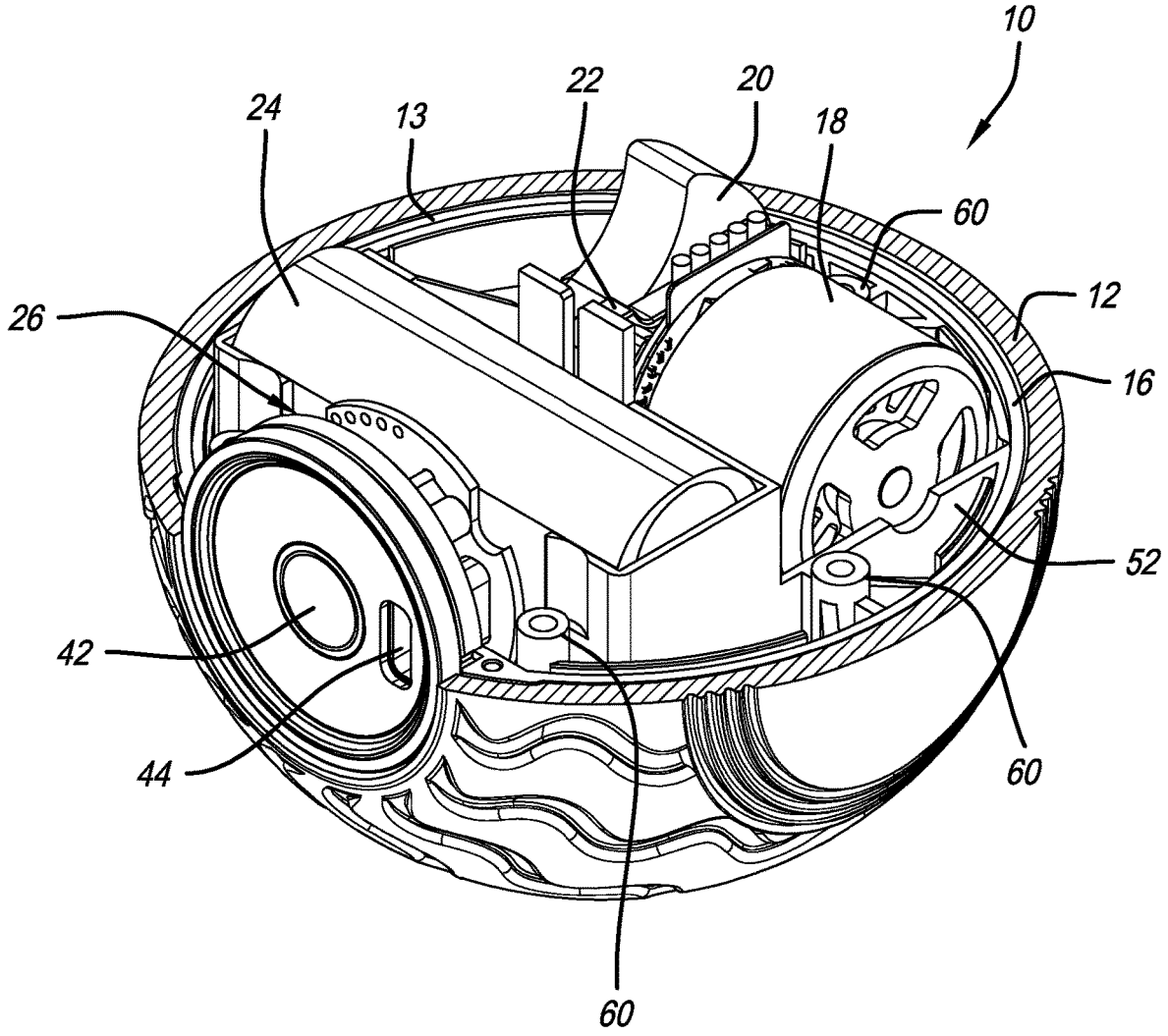
FIG. 2 is a perspective view of the vibrating ball assembly with a portion in cross-section.
Figure 3:
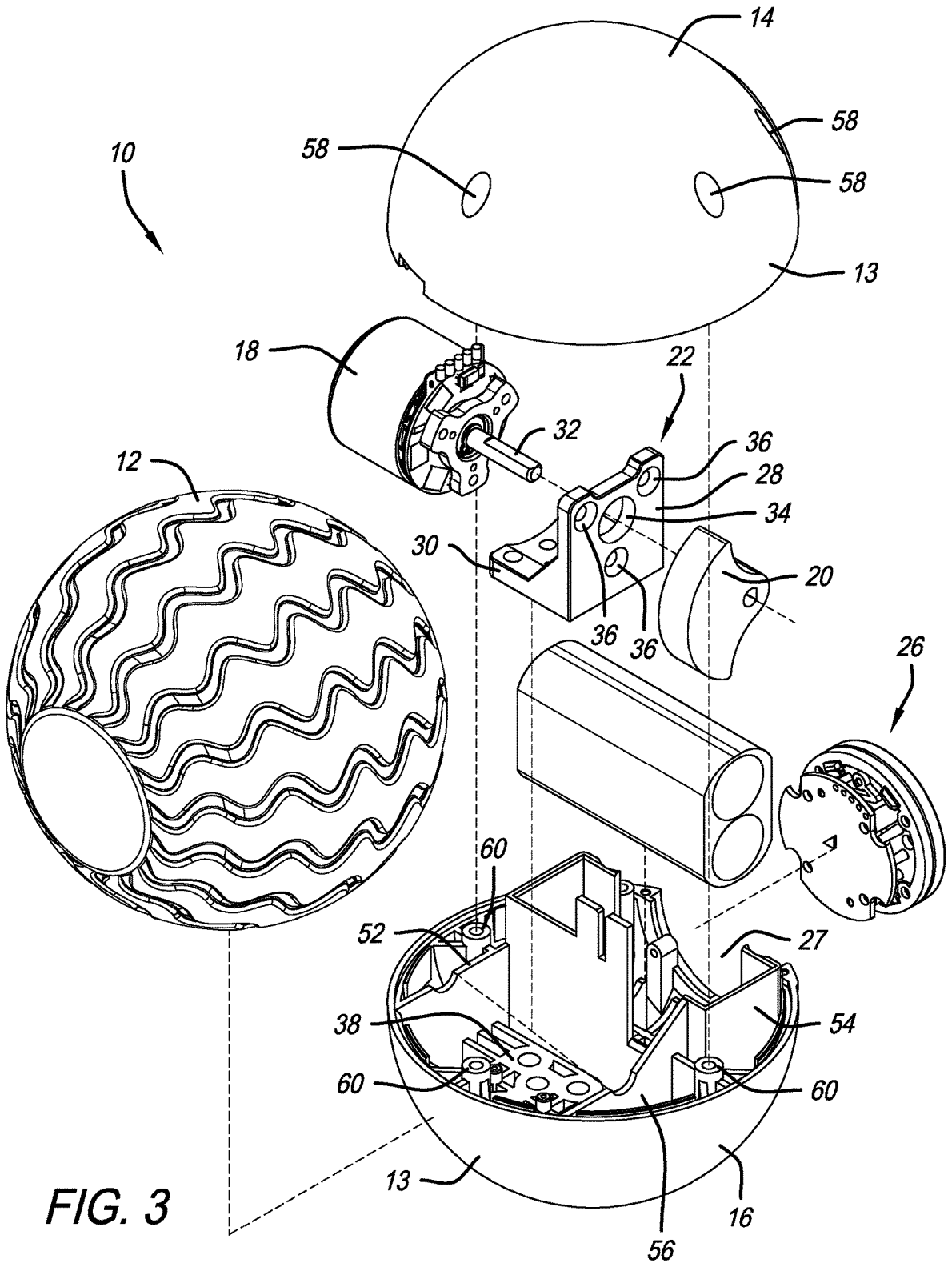
FIG. 3 is an exploded perspective view of the vibrating ball assembly.

FIGS. 1-11 show a vibrating ball assembly 10 in accordance with a preferred embodiment of the present invention. As shown in FIGS. 1-3, in a preferred embodiment, the vibrating ball assembly 10 generally includes an outer cover 12 that is made of foam or a similar material, a first shell portion 14, a second shell portion 16, a motor 18, an eccentric weight 20, a motor mount bracket 22, a battery 24 and an electronics assembly 26.

As shown in FIG. 3, the motor mount bracket 22 includes a motor portion 28 and a shell portion 30. The motor 18 includes a motor shaft 32 that extends through a shaft opening 34 defined in the motor portion 28. The eccentric weight 20 is received on and attached to the motor shaft 32 on the opposite side of the motor portion 28 as the motor 18. In a preferred embodiment, the motor portion 28 also includes fastener openings 36 defined therein through which fasteners, such as threaded fasteners extend and connect, attach of mount the motor 18 to the motor portion 28 of the motor mount bracket 22.

Figure 4:
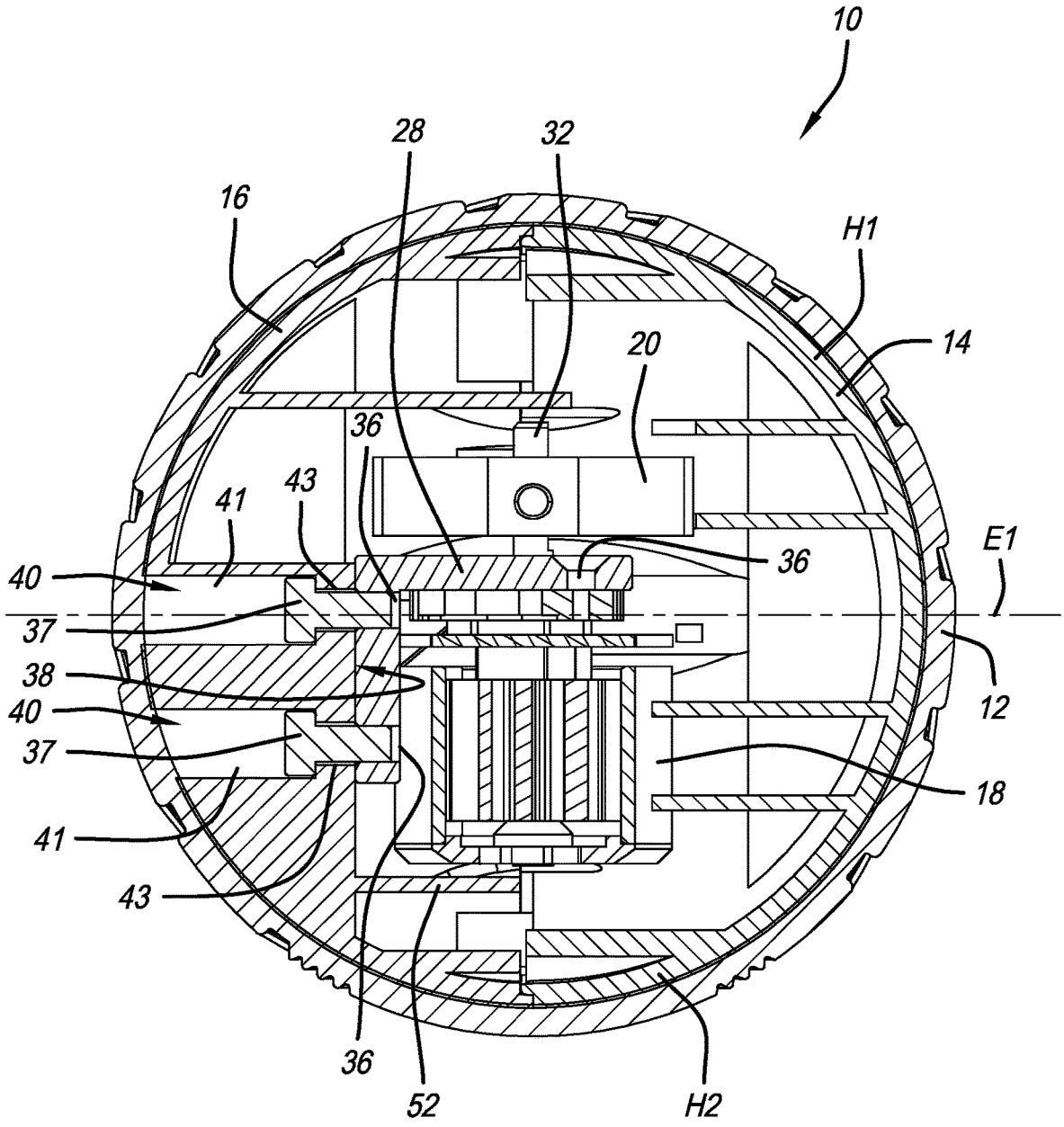
FIG. 4 is a cross-section of the vibrating ball assembly.
Figure 7:
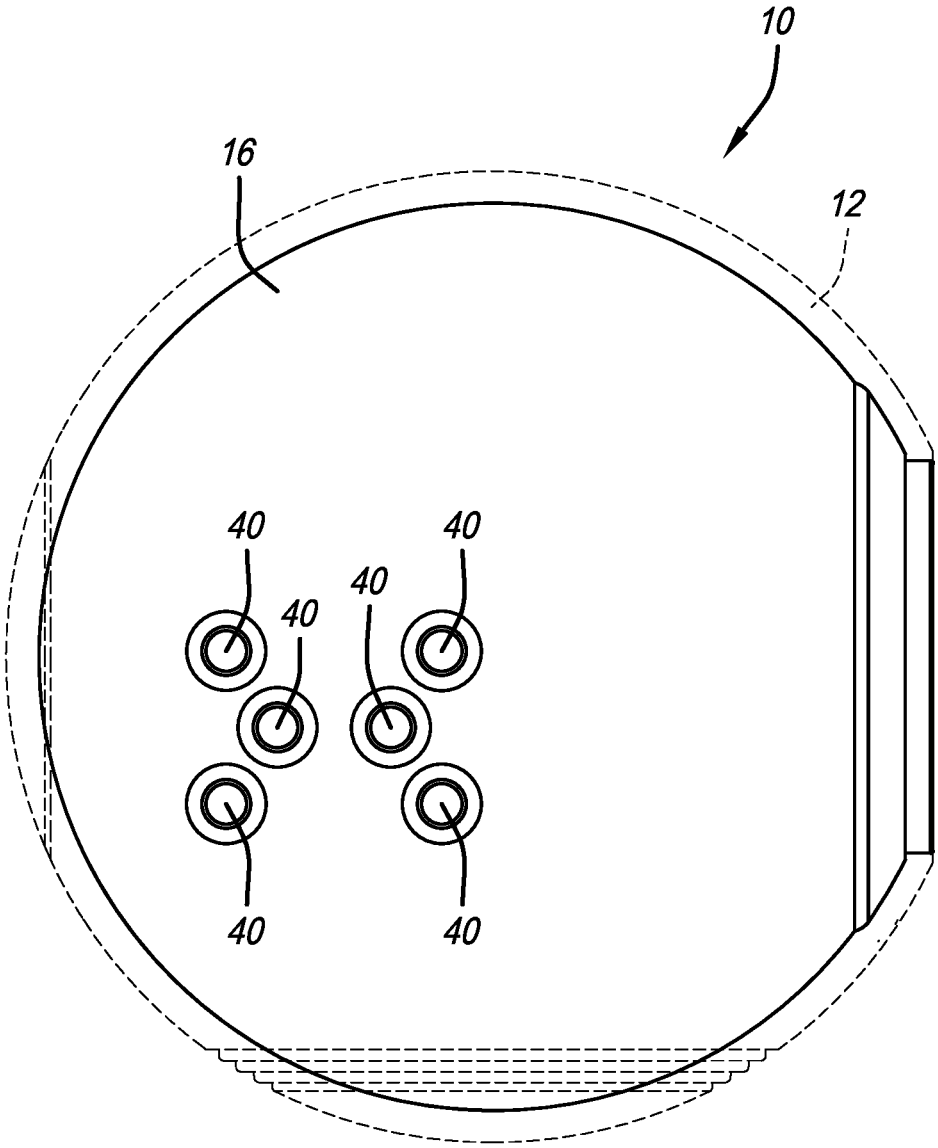
FIG. 7 is an elevational view of the vibrating ball assembly showing the elongated attachment openings in the second shell portion and the outer cover in hidden lines.
Figure 8:
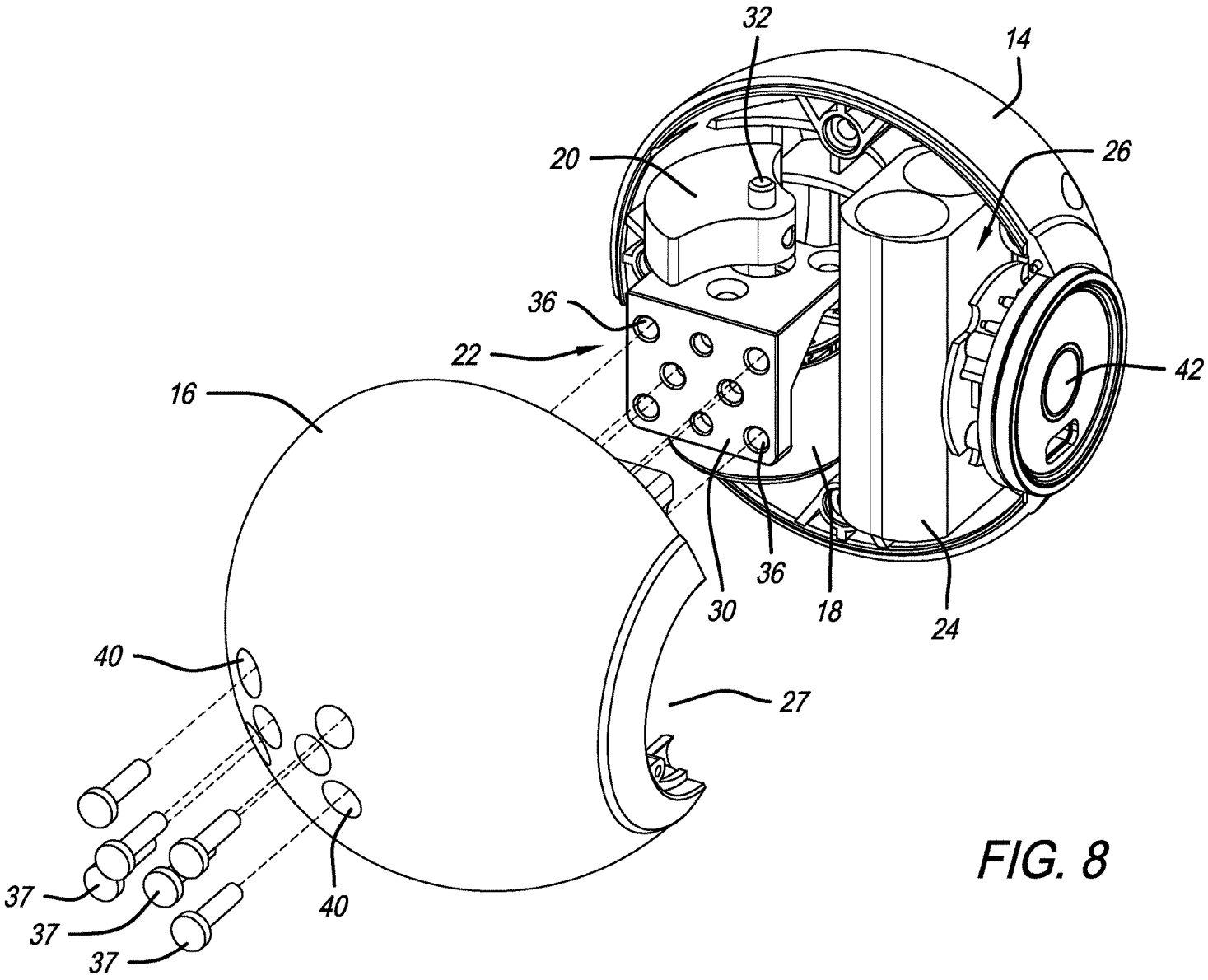
FIG. 8 is a perspective view of the vibrating ball assembly showing the threaded fasteners exploded from the second shell portion.

As shown in FIGS. 3-4, in a preferred embodiment, the shell portion 30 of the motor mount bracket 22 includes fastener openings 36 defined therein through which fasteners, such as threaded fasteners 37 extend and connect the shell portion 30 and the motor mount bracket 22 to the second shell portion 16. In a preferred embodiment, the second shell portion 16 includes a bracket seat 38 on which the motor mount bracket 22 is seated and attached. As shown in FIGS. 4 and 7-8 elongated bracket attachment openings 40 are defined in and extend through the second shell portion 16. FIGS. 7-8 shows six elongated bracket attachment openings 40 that align with six fastener openings 36 in the shell portion 30. However, any number of elongated attachment openings and fastener openings 36 is within the scope of the invention (e.g., 1-10). Fasteners extend through the elongated bracket attachment openings 40 and the fastener openings 36 and secure the motor mount bracket 22 to the bracket seat 38 of the second shell portion 16. The elongated openings include a larger diameter portion 41 that is essentially a tunnel through the second shell portion 16 to insert the threaded fastener and insert a screwdriver or other tool therein and a small diameter portion 43 that receives the shank of the threaded fastener. The head of the threaded fastener contacts a shoulder created by the change in diameter from the larger diameter portion 41 to the smaller diameter portion 43.

As shown in FIG. 2, the electronics assembly 26 includes one or more buttons 42 and/or a screen thereon for operation of the vibrating ball assembly 10 (e.g., on/off, changing speeds, connecting to Bluetooth, etc.). The electronics assembly 26 also includes a charging and/or connecting port 44 a PCB and other necessary electronics for controlling the vibrating ball assembly. The electronics assembly is preferably located in an opening 27 defined in the first and second shell portions 14 and 16. A first half of opening 27 is defined in the first shell portion 14 and a second half of opening 27 is defined in the second shell portion 16.

As shown in FIGS. 7-11, the first shell portion 14 includes a plurality of elongated shell attachment openings 58 for receiving threaded fasteners or the like that are received in and secured in receiver members 60 in the second shell portion 16 that secure the first shell portion 14 to the second shell portion 16. The first shell portion 14 also includes battery securing members 46 that secure the battery 24 in position within a battery seat in the second shell portion 16.

In use, the motor 18 rotates the eccentric weight, which creates a vibration that is transmitted to the outer cover 12 and to the user that is using the vibrating ball assembly. The brushless motor 18 is strong enough to rotate the eccentric weight 20 and provide a sufficient vibration. In another embodiment a brush motor can be used.

In a preferred embodiment, the vibrating ball assembly 10 includes a low or reduced vibration section 50 demarcated on the outer cover 12. The reduced vibration section is also referred to herein as a demarcation circle 50. In the embodiment shown in the figures, the outer cover includes a plurality of circular ridges or undulations. The outermost ridge is considered the demarcation circle. As a result of the configuration of the components within the first and second shell portions 14 and 16 (the entire shell is referred to herein as the inner shell 13), the amplitude of the vibrations transferred through the inner shell 13 is less in at least one area than in other areas. It will be appreciated that the vibrating ball assembly is used as oriented as shown in FIG. 4-9, with the reduced vibration section 50 at the bottom and the electronics assembly 26 facing generally sideways (an axis defined by the electronics assembly extends horizontally). Due to the configuration of the components, the upper hemisphere H1 includes a higher amplitude or intensity of vibrations than the lower hemisphere H2. As a result, lower amplitude vibrations are transferred to the outer cover 12. Therefore, the reduced vibration section 50 is used to designate to a user which portion of the sphere has lower amplitude vibrations.

In use, prior art vibrating balls cause the floor to vibrate, which can be loud. The present invention helps reduce the amount of vibration that is transferred to the floor or other surface on which the device is placed. Therefore, in use, the reduced vibration section 50 is placed on the floor or other horizontal surface and the user uses the upper portion (approximately the upper half) of the sphere to "roll on". As a result of the lower amplitude of vibration, the vibrations transferred to the floor are less than if the upper portion of the sphere were placed against the floor.

Figure 5:
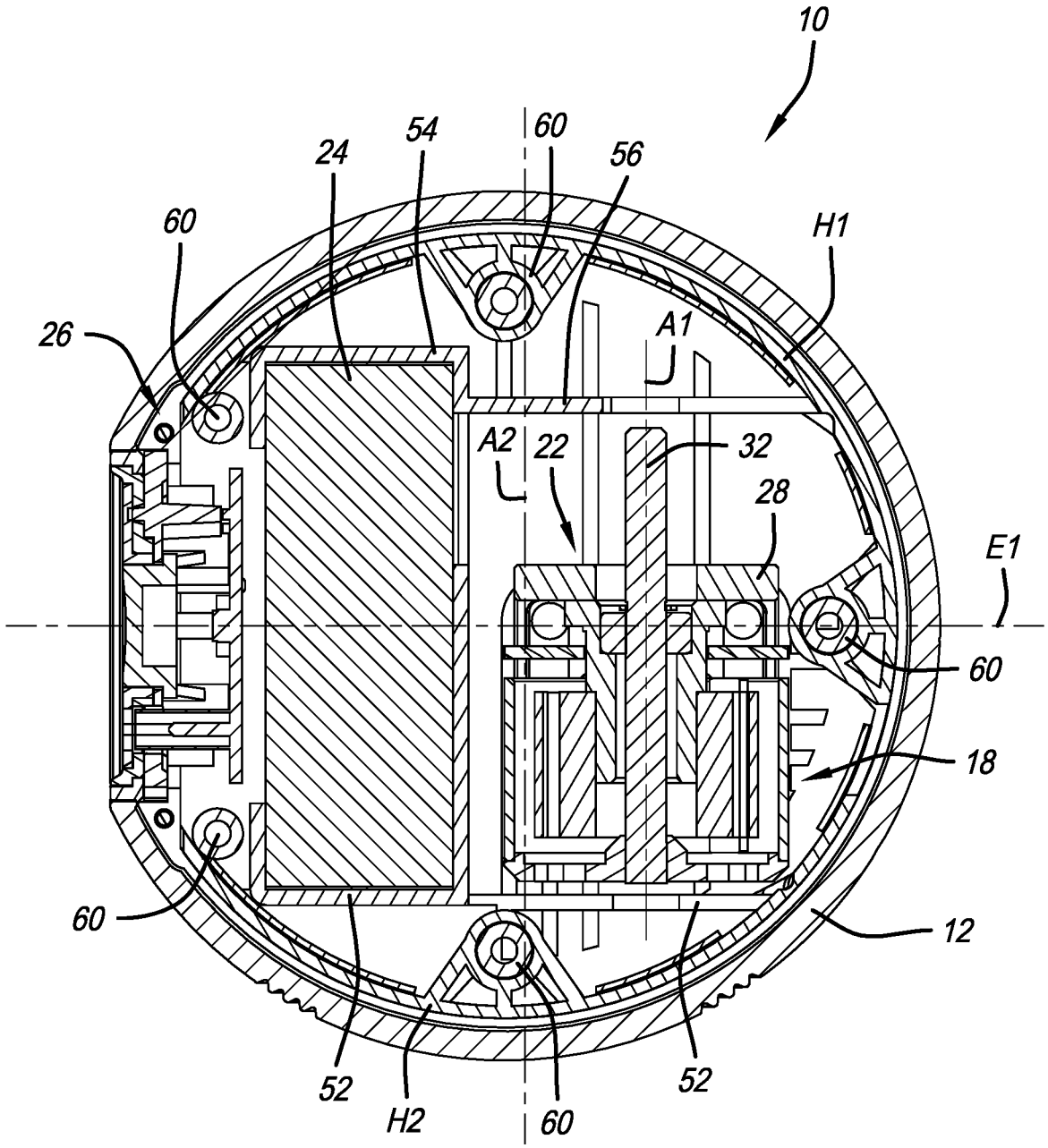
FIG. 5 is a cross-section of the vibrating ball assembly taken at 90° from FIG. 4.
Figure 6:
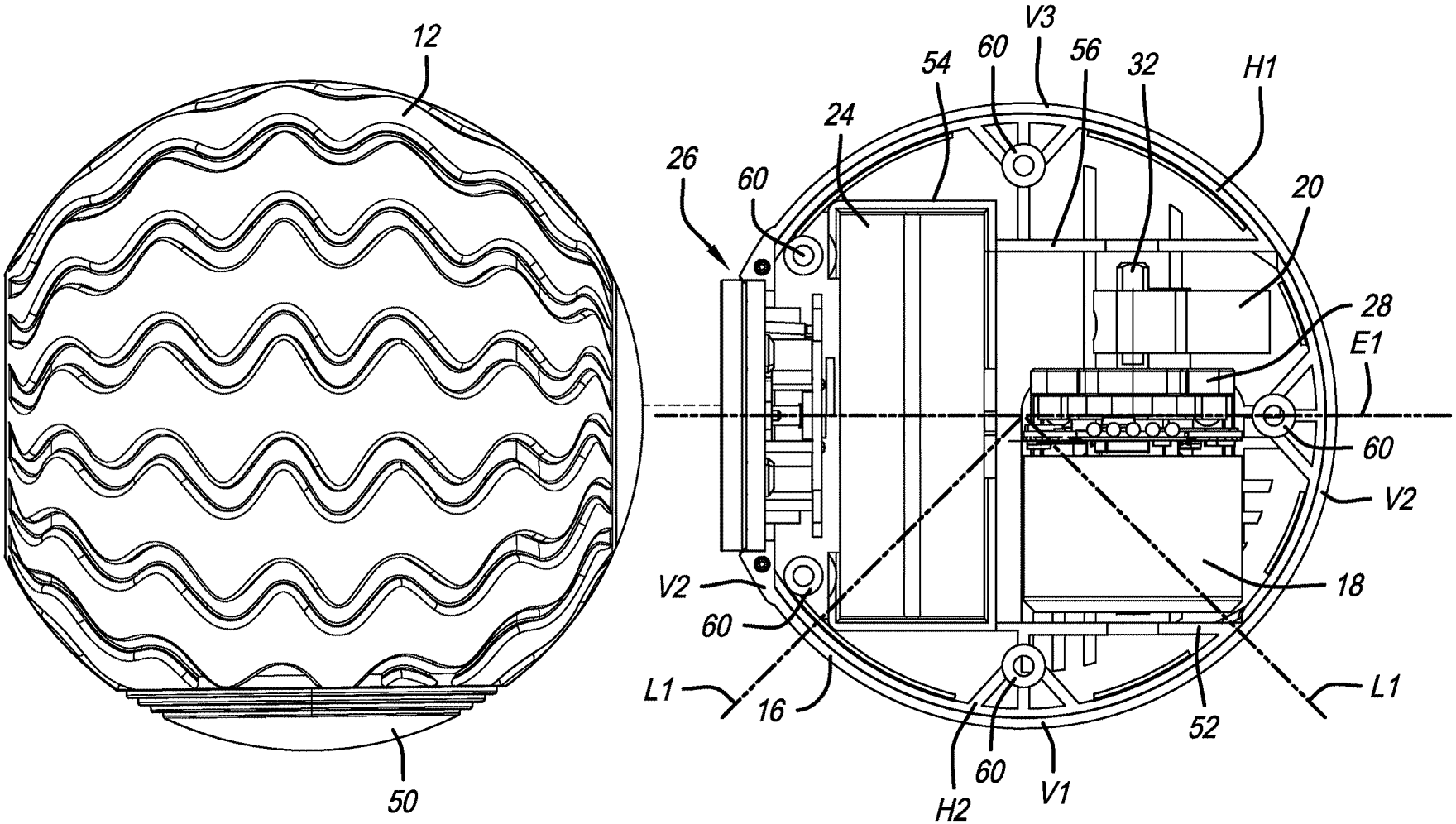
FIG. 6 is an elevational view of the vibrating ball assembly with the outer cover next to the inner portion with the first shell portion removed.

FIGS. 2-6 show the configuration of the inner components. As shown in FIGS. 4-6, when the sphere is oriented such that the reduced vibration section is placed on the floor, the motor 18 is oriented such that the motor shaft 32 extends upwardly (i.e., the motor shaft axis extends vertically), the eccentric weight 20 (which generates the vibrations) is in the upper half or hemisphere H1 of the sphere and inner shell 13 (see the dashed line E1 showing the equatorial plane of the sphere in FIGS. 4-6). In a preferred embodiment, the motor shaft 32 extends vertically from the lower half or hemisphere H2 of the sphere (where the motor is located), through the equatorial plane E1 (or equatorial plane) and to the upper half. The eccentric weight 20 is preferably positioned in the upper hemisphere H1. Because eccentric rotation of the eccentric weight in the upper hemisphere H1 and the motor is located in the lower hemisphere H2, higher intensity vibrations are created in the upper hemisphere than in the lower hemisphere. And, within the lower hemisphere, the intensity of the vibrations reduce closer to the center of the reduced vibration section 50 (the center of rotation) or the lower pole. Consider how a top spins just before it falls over with the upper portion spinning eccentrically, but with the lowermost point (the center of rotation) still spinning on place on a surface. FIG. 6 shows the inner shell 13 divided into three different vibration sections, V3 is the upper hemisphere, which includes the highest intensity of vibrations. The lower hemisphere H2 includes two sections V2 (bordered by the equatorial plane E1 and line L1) that have a lower intensity of vibration than V3, but a higher intensity of vibration than section V1 (between lines L1), which is the lowest intensity vibration section and is the reduced vibration section. It will be appreciated that FIG. 6 is two dimensional, but that the lines L1 and equatorial plane E1 form three dimensional on the three dimensional sphere or ball.

In a preferred embodiment, the axis of rotation A1 of the motor shaft 32 extends or is oriented vertically. In a preferred embodiment, the axis of rotation of the motor shaft 32 is coaxial with the center axis A2 of the vibrating ball assembly. In another embodiment, all or a portion of the motor can be positioned in the upper half together with the eccentric weight. In another embodiment, the motor and battery can be positioned in the lower hemisphere and the eccentric weight can be positioned in the upper hemisphere. In this embodiment, the weight of the motor and battery help stabilize the lower hemisphere (and the reduced vibration section) while the eccentric weight creates vibrations in the upper hemisphere.

Figure 9:
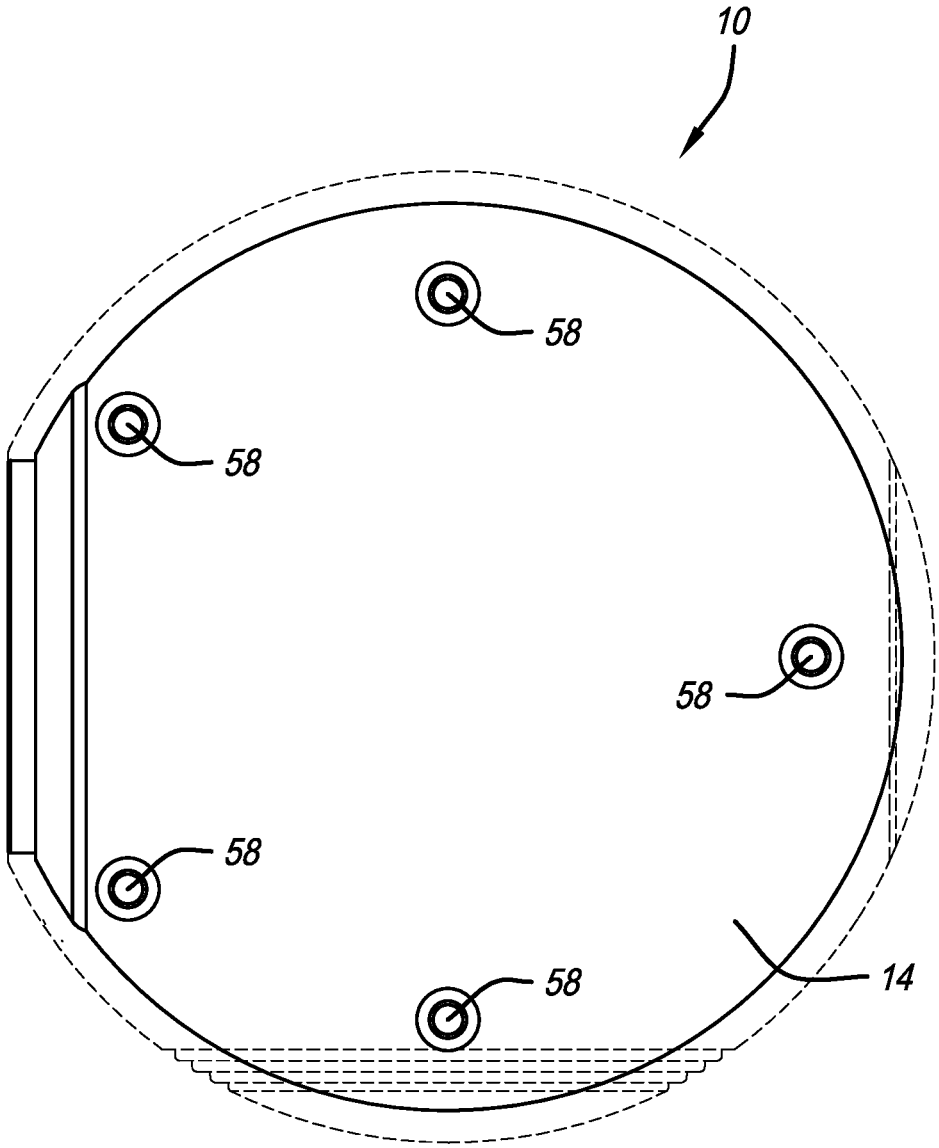
FIG. 9 is an elevational view of the vibrating ball assembly showing the elongated attachment openings in the first shell portion and the outer cover in hidden lines.
Figure 10:
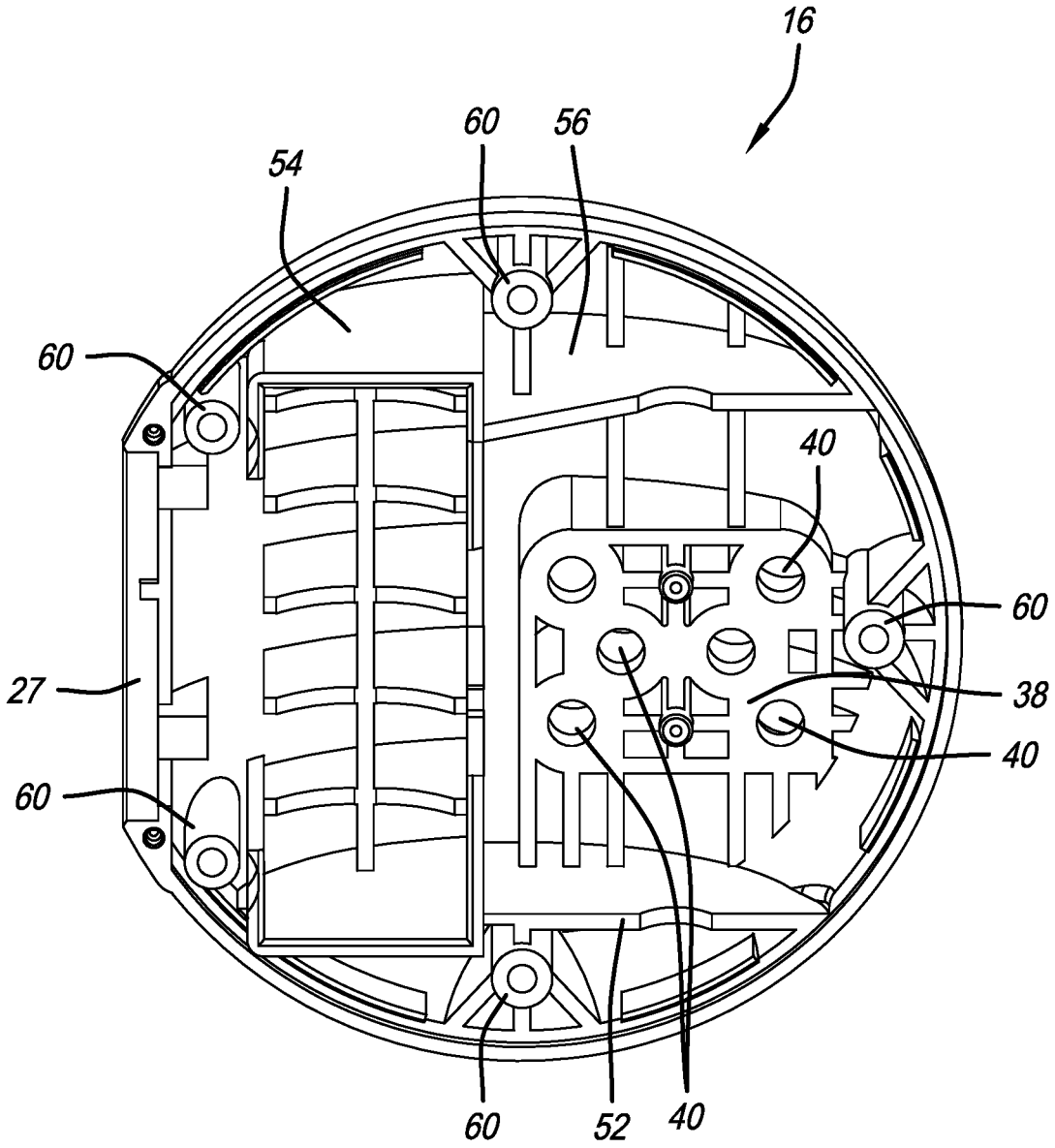
FIG. 10 is a perspective view of the second shell portion.
Figure 11:
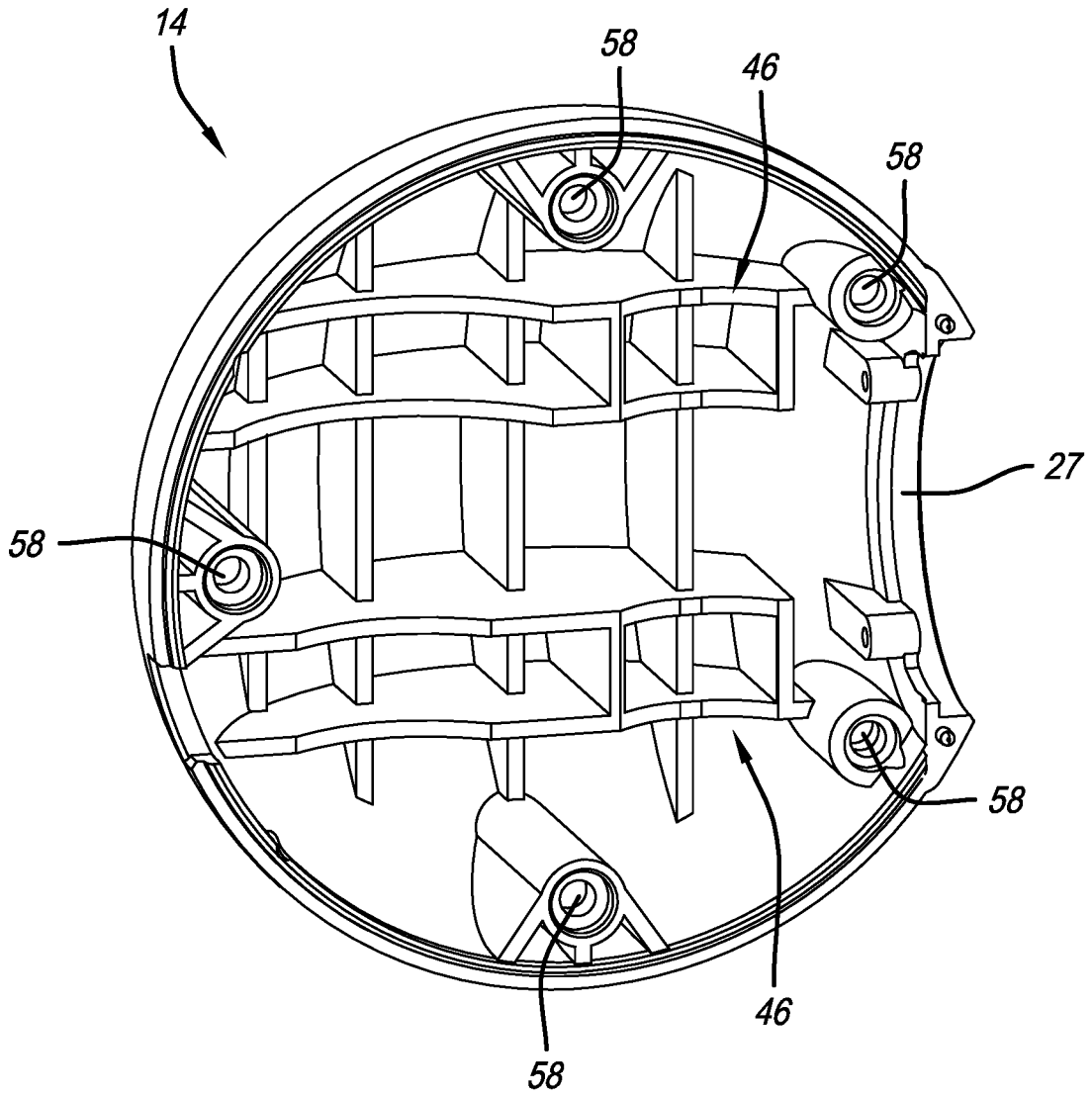
FIG. 11 is a perspective view of the first shell portion.

As shown in FIG. 9, the motor portion 28 of the motor mount bracket 22 is also located in the upper half. The motor is directly attached to the motor portion 28. Therefore, the vibrations are transferred to this component. The eccentric weight and motor portion 28 are located closer to the upper pole than the lower pole and the lower pole is part of (preferably the center of) the reduced vibration section. As can also be seen in FIG. 4, the first and second shell portions 14 and 16 form the right and left halves or sides of the inner shell 13 when the sphere is oriented such that the reduced vibration section 50 is positioned on the floor. As shown in FIGS. 5 and 10, the inner shell 13 also includes a lower wall 52 that spans the inner shell 13 interior and forms at least a portion of a battery housing 54 and a motor housing 56.

In a preferred embodiment, the reduced vibration section or V1 makes up about 1% to about 50% of the surface area of the outer surface of the outer cover (the lower hemisphere). In a more preferred embodiment, the reduced vibration section makes up about 5% to about 20% of the surface area of the outer surface of the outer cover; in the most preferred embodiment, the reduced vibration section makes up about 8% to about 9% of the surface area of the outer surface of the cover.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶ 6, other aspects may likewise be embodied as a means-plus-function claim, or in other forms, such as being embodied in a computer-readable medium. (Any claims intended to be treated under 35 U.S.C. § 112, ¶ 6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A vibrating ball assembly comprising:

an inner shell that defines an inner shell interior and includes an outer surface, wherein the inner shell includes an upper hemisphere and a lower hemisphere, wherein the inner shell includes a first shell portion and a second shell portion;

a motor positioned in the inner shell interior, wherein the motor is secured to a motor mount bracket that includes a motor portion and a shell portion that are formed as a single piece, wherein the motor is secured to the motor portion, and wherein the shell portion is secured to the second shell portion;

an eccentric weight that is configured to be rotated by the motor, an outer cover at least partially covering the outer surface of the inner shell, wherein the outer cover includes a reduced vibration section positioned in the lower hemisphere; and an electronics assembly that defines an electronics assembly axis, wherein the upper and lower hemispheres are physically separated by an equatorial plane, wherein a first electronics assembly opening is defined through the inner shell, wherein a second electronics assembly opening is defined through the outer cover, wherein the electronics assembly is received in the first and second electronics assembly openings, such that the electronics assembly spans the equatorial plane and extends from the upper hemisphere to the lower hemisphere, and wherein the electronics assembly axis is co-planar with the equatorial plane.

2. The vibrating ball assembly of claim 1, wherein when the motor is activated the eccentric weight is rotated and vibrations having at least first and second amplitudes are transmitted to the outer cover, wherein the first amplitude is greater than the second amplitude, wherein the first amplitude is transmitted to the upper hemisphere and the second amplitude is transmitted to the reduced vibration section.

3. The vibrating ball assembly of claim 1, wherein the eccentric weight is positioned in the upper hemisphere.

4. The vibrating ball assembly of claim 3, wherein the motor is positioned at least partially in the lower hemisphere.

5. The vibrating ball assembly of claim 1, wherein the motor includes a motor shaft, and wherein the motor shaft extends from the lower hemisphere to the upper hemisphere.

6. The vibrating ball assembly of claim 5, wherein the motor shaft includes a rotation axis that is oriented vertically.

7. The vibrating ball assembly of claim 1, wherein the outer cover includes a demarcation circle that demarcates the reduced vibration section and wherein the demarcation circle is located below the equatorial plane.

8. The vibrating ball assembly of claim 7, wherein the demarcation circle includes a center that is coaxial with a lower pole of the outer cover.

9. The vibrating ball assembly of claim 8, wherein the inner shell includes a lower wall that spans the lower hemisphere, wherein the lower wall is positioned between the motor and the reduced vibration section.

10. The vibrating ball assembly of claim 1, wherein the inner shell includes a lower wall that spans the lower hemisphere and is parallel to the equatorial plane, wherein the lower wall is positioned between the motor and the lower pole.

11. The vibrating ball assembly of claim 1, wherein the second shell portion includes a bracket seat on which the shell portion of the motor mount bracket is seated, wherein the motor mount bracket is secured to the bracket seat by one or more fasteners extending through the second shell portion, wherein the one or more fasteners are accessible from an inner shell exterior.

12. The vibrating ball assembly of claim 1, wherein the motor includes a motor shaft that extends through a shaft opening defined in the motor portion of the motor mount bracket, wherein the eccentric weight is positioned in the upper hemisphere on an upper side of the motor portion of the motor mount bracket and the motor is positioned on a lower side of the motor portion of the motor mount bracket and at least partially in the lower hemisphere.

13. The vibrating ball assembly of claim 1, wherein a first half of the first electronics assembly opening is defined in the first shell portion and a second half of the first electronics assembly opening is defined in the second shell portion.

14. The vibrating ball assembly of claim 1, wherein the electronics assembly includes a button accessible from the inner shell exterior.

15. A vibrating ball assembly comprising:

an inner shell that defines an inner shell interior and includes an outer surface, wherein the inner shell includes an upper hemisphere and a lower hemisphere, and wherein the inner shell includes a first shell portion and a second shell portion, a motor positioned in the lower hemisphere, wherein the motor is secured to a motor mount bracket that includes a motor portion and a shell portion that are formed as a single piece, wherein the motor is secured to the motor portion, and wherein the shell portion is secured to the second shell portion, wherein the second shell portion includes a bracket seat on which the shell portion of the motor mount bracket is seated, wherein the motor mount bracket is secured to the bracket seat by one or more fasteners extending through the second shell portion, wherein the motor includes a motor shaft that extends from the lower hemisphere to the upper hemisphere, and wherein the motor shaft includes a rotation axis that is oriented vertically, an eccentric weight received on the motor shaft and configured to be rotated by the motor, wherein the eccentric weight is positioned in the upper hemisphere, an outer cover at least partially covering the outer surface of the inner shell, wherein the inner shell includes a reduced vibration section positioned in the lower hemisphere, wherein the outer cover includes a demarcation circle that demarcates the reduced vibration section, wherein the demarcation circle includes a center that is coaxial with a lower pole of the outer cover, and an electronics assembly that defines an electronics assembly axis, wherein the upper and lower hemispheres are separated by an equatorial plane, wherein a first electronics assembly opening is defined through the inner shell, wherein a second electronics assembly opening is defined through the outer cover, wherein the electronics assembly is received in the first and second electronics assembly openings, such that the electronics assembly spans the equatorial plane and extends from the upper hemisphere to the lower hemisphere, and wherein the electronics assembly axis is co-planar with the equatorial plane.

16. The vibrating ball assembly of claim 15, wherein the inner shell includes a lower wall that spans the lower hemisphere, wherein the lower wall is positioned between the motor and the reduced vibration section.

17. The vibrating ball assembly of claim 16, wherein the motor shaft extends through a shaft opening defined in the motor portion of the motor mount bracket, wherein the eccentric weight is positioned in the upper hemisphere on an upper side of the motor portion of the motor mount bracket and the motor is positioned on a lower side of the motor portion of the motor mount bracket and at least partially in the lower hemisphere.

* * * * *